United States Patent [19]

Sluijterman et al.

[11] 4,455,542

[45] Jun. 19, 1984

[54] DEVICE FOR DISPLAYING TELEVISION PICTURES INCLUDING A DEFLECTION UNIT THEREFOR

[75] Inventors: Albertus A. S. Sluijterman; Nicolaas G. Vink, both of Eindhoven, Netherlands

[73] Assignee: U.S. Philips Corporation, New York, N.Y.

[21] Appl. No.: 471,973

[22] Filed: Mar. 4, 1983

[30] Foreign Application Priority Data

Jan. 6, 1983 [NL] Netherlands ..... 8300032

[51] Int. Cl.[3] ..... H01H 5/00

[52] U.S. Cl. ..... 335/213; 313/428

[58] Field of Search ..... 335/210, 213; 313/421, 313/426, 427, 428

[56] References Cited

U.S. PATENT DOCUMENTS 3,195,025 7/1965 Marley ..... 335/213

4,152,685 5/1979 Renders et al. ..... 335/213

*Primary Examiner*—George Harris

*Attorney, Agent, or Firm*—Thomas A. Briody; William J. Streeter

[57] ABSTRACT

A device for displaying television pictures comprising a display tube in the neck of which a gun system is present for emitting at least one electron beam towards a display screen, and comprising an electromagnetic deflection unit which is provided around the envelope of the display tube and which comprises a first deflection coil and a second deflection situated coaxially with respect to the first deflection coil, each having two diametrically oppositely located coil units. Each coil unit of the first deflection coil consists of two sub-coil units which are arranged axially with respect to each other, the sub-coil units which are present on the side of the gun system having a winding distribution for together generating a dipole deflection field in combination with a positive sixpole deflection field, the sub-coil units which are present on the side of the display screen having a winding distribution for together generating a dipole field in combination with a negative sixpole field on their sides remote from the display screen and a positive sixpole field on their sides facing the display screen.

8 Claims, 12 Drawing Figures

DEVICE FOR DISPLAYING TELEVISION PICTURES INCLUDING A DEFLECTION UNIT THEREFOR

The invention relates to a device for displaying television pictures comprising a display tube in the neck of which an electron gun system is present for emitting at least one electron beam towards a display screen, and comprising an electro-magnetic deflection unit which is provided around the envelope of the display tube and which comprises a first deflection coil and a second deflection coil situated coaxially with respect to the first deflection coil, each comprising two diametrically oppositely located coil units.

In monochrome display tubes the electron gun system is designed to produce one electron beam. In color display tubes the electron gun system is designed to produce three electron beams.

For some time color display tubes have been used in which three electron guns which are spatially separated from each other are situated on one line. Such a display tube is known as an in-line color display tube. In the in-line color display tube it is endeavoured to use a deflection unit having deflection coils which give such an inhomogeneous field distribution that the beams of the electron guns upon deflection coincide over the whole screen. For that purpose in particular the line deflection field (to be generated by the second deflection coil) on the gun side of the deflection yoke must be barrel-shaped and must be pincushion-shaped towards the screen side and, just conversely, the frame deflection field (to be generated by the first deflection coil) on the gun side must be pincushion-shaped and must be barrel-shaped more towards the screen side.

The extent of pincushion-shape and barrel-shape is such that upon deflection the convergence errors of the electron beams irradiated by the electron guns are corrected so that pictures having satisfying convergence properties can be produced on the screen of the display tube. Display tube deflection yoke combinations of this type are termed self-converging.

When in this manner the convergence is ensured (for that purpose the deflection coils must often be combined with auxiliary means for intensifying the pincushion shape and/or barrel shape of the deflection fields, which auxiliary means are, for example, plates of soft-magnetic metallic material placed in the deflection fields) a disturbing frame distortion (east-west frame distortion) often occurs on the vertical sides of the display screen and has to be corrected.

SUMMARY OF THE INVENTION

It is therefore an object of the invention to provide a device of the above-mentioned type for displaying television pictures which is self-converging without requiring extra auxiliary means (the use of the plates of soft-magnetic, metallic material is inefficient considered, for example, from an energy point of view) and which needs no east-west frame correction.

This object is achieved in that each coil unit of the first deflection coil consists of two sub-coil units which are arranged axially with respect to each other, the sub-coil units which are present on the side of the gun system having a winding distribution for generating a dipole deflection field in combination with a positive sixpole deflection field, the sub-coil units which are present on the side of the display screen having a winding distribution for generating a dipole field in combination with a negative sixpole field on their sides remote from the display screen and a positive sixpole field on their sides facing the display screen.

It has been found that the construction of the first deflection coil (the coil for deflecting the electron beams in the vertical direction, or frame deflection coil) in the form of two sub-coils of which one faces the gun system and generates a dipole field in combination with a positive sixpole field (resulting in a pincushion-shaped deflection field) and the other, which faces the display screen, generates a dipole field in combination with on its rear side a negative sixpole field (resulting in a barrel-shaped deflection field), and having on its front side a positive sixpole field (resulting in a pincushion-shaped deflection field) may result in a television display device which satisfies the requirements imposed as regards self-convergence and frame distortion. With the present-day winding techniques a single frame deflection coil cannot be made which results in a television display device which satisfies the requirements imposed. According to the invention, however, in a frame deflection coil which consists of only two sub-coils the sub-coil facing the display screen can be wound so that the astigmatism error and the east-west frame distortion are minimum and the sub-coil facing the gun system can be wound so that the coma error is minimum and that the strength of the deflection field has the correct value. (The strength is determined on the one hand by the number of turns of the sub-coil in question and on the other hand by the strength of the current which traverses it upon energization). The associated line deflection coil need not be divided into sub-coils and may be a conventional single coil.

An embodiment of the device in accordance with the invention which is simple to realize is characterized in that sub-coil units which are present on the side of the display screen are provided around a conical portion of the display tube and that the sub-coil units which are present on the side of the gun system are provided around a neck portion of the display tube. The rear sub-coil units in that case may have a cylindrical shape (and together constitute a sub-coil of the saddle type) and the front sub-coil units may be conical or frustoconical. The front sub-coil units together in addition may form either a sub-coil of the saddle type, or a sub-coil of the type wound axially around an annular core.

In the case in which the front sub-coil is of the saddle type, the shape of the window apertures of the front sub-coil units is essentially triangular, the narrowest portion of the window aperture facing the gun system. The shape of the window apertures of the front (saddle type) sub-coil units is essentially rectangular.

A particular aspect of the use of a frame deflection coil which consists of two sub-coils is that, by varying the distance betwen the two sub-coils, the effect of the (negative) sixpole field in the center can be made larger or smaller. Dependent on the distance, an oncoming electron beam actually has already experienced a larger or smaller deflection. The larger said (pre)deflection is, the larger is the effect of the negative sixpole field and hence the larger is the effect of the astigmatism.

The invention also relates to a deflection unit for use in a device as described above.

DESCRIPTION OF THE FIGURES

An embodiment of the invention will be described in greater detail with reference to the drawing.

DESCRIPTION OF THE PREFERRED EMBODIMENT

Figure 1:
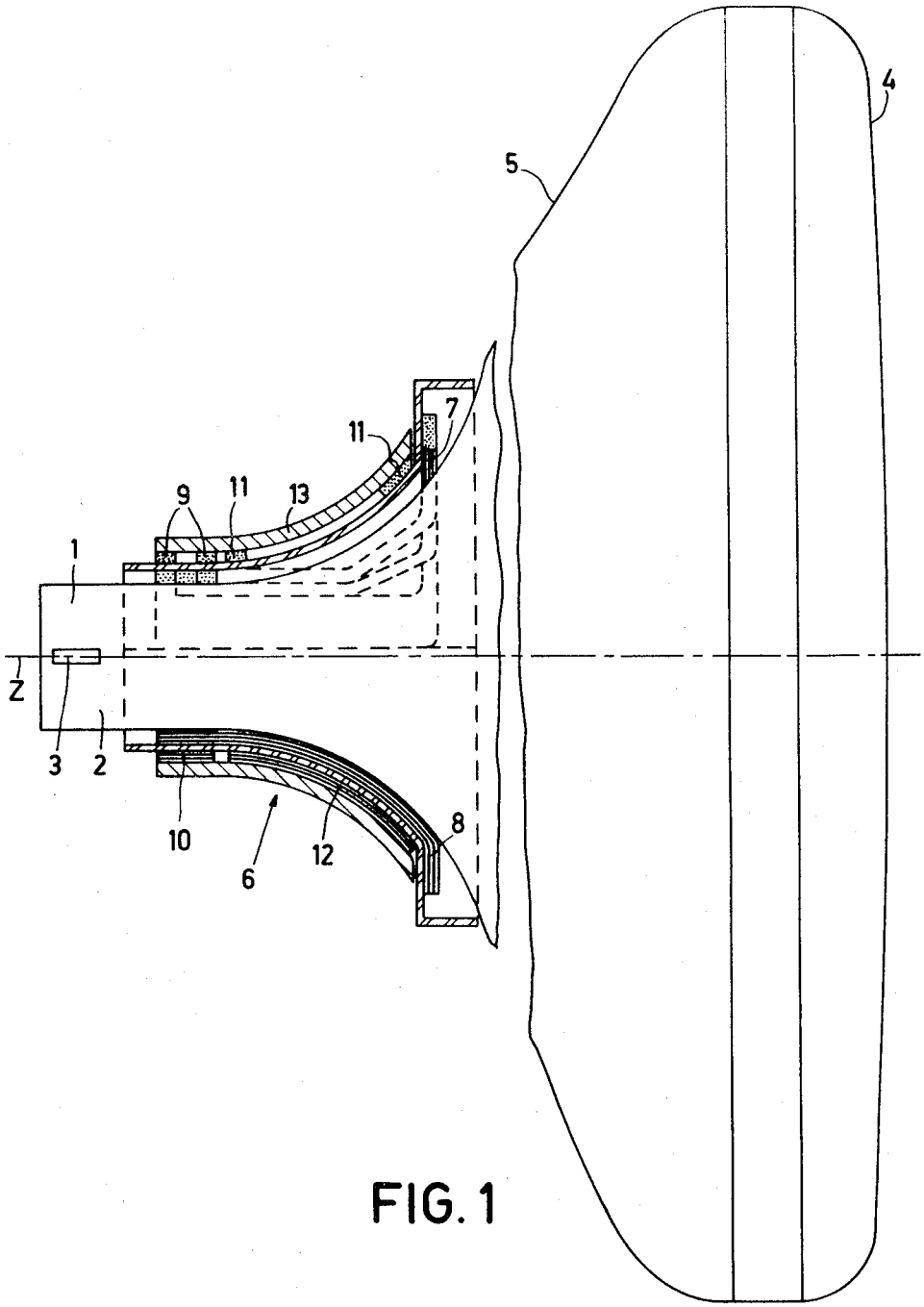
FIG. 1 is a diagrammatic cross-sectional view through a color television display tube on which a deflection unit has been assembled.

FIG. 1 shows a color television display device comprising a display tube 1 of the three-in-line type having a neck portion 2 in which an electron gun system 3 is placed to generate three electron beams situated in one plane and comprising a display screen 4 on which recurring groups of red, blue and green phosphor dots are provided in front of a (hole) mask.

A deflection unit 6 is provided around the envelope 5 of the display tube 1. It comprises a line deflection coil formed by two line deflection coil units 7, 8 and a frame deflection coil formed by two sub-deflection coil units 9, 10 which form a sub-deflection coil facing the gun system 3 and two sub-deflection coil units 11, 12 which form a sub-deflection coil facing the display screen 4. An annular core 13 of soft-magnetic material is placed coaxially around the line deflection coil and the frame deflection coil which in the Figure are both shown as coils of the saddle type.

Figure 2:
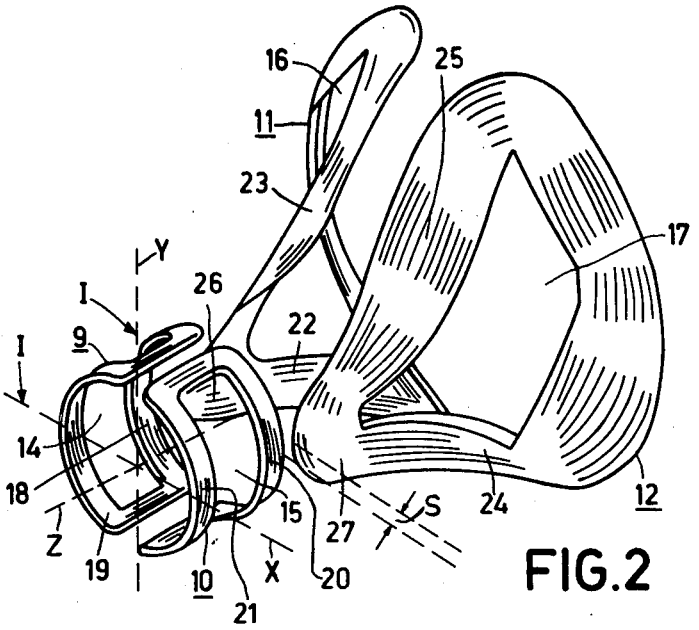
FIG. 2 shows diagrammatically a frame coil having two coils for use in a device according to the invention.
Figure 3A:
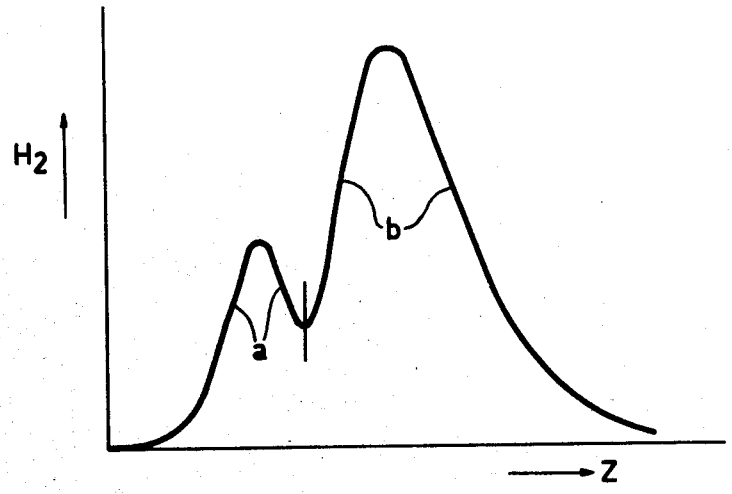
FIG. 3*a* shows the dipole field generated by the frame coil of FIG. 2.
Figure 3B:
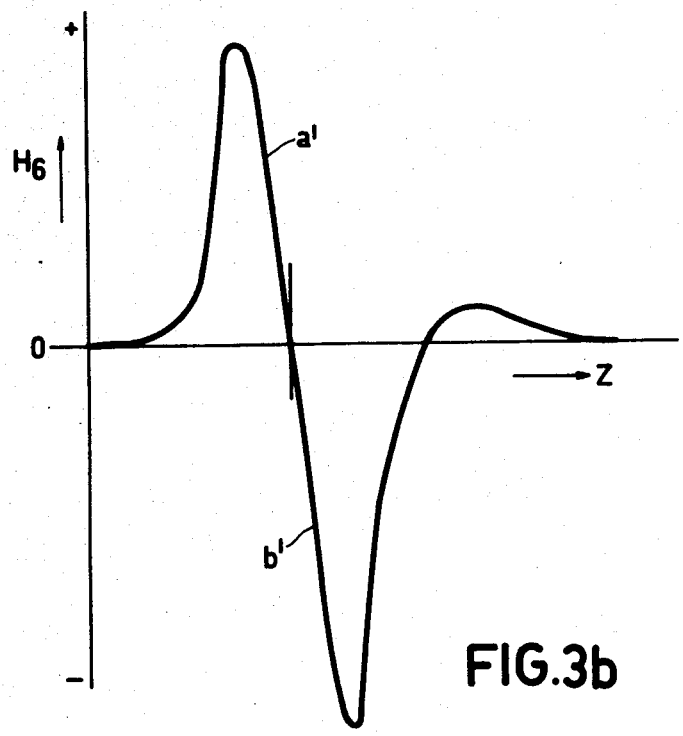
FIG. 3*b* shows the sixpole field generated by the frame coil of FIG. 2.

The frame deflection coil is shown separately in FIG. 2. The (rear) sub-coil units 9 and 10 are formed by packets of turns which enclose windows 14 and 15, respectively. The window apertures are essentially of rectangular shape so as to produce a dipole field in combination with a positive sixpole field upon energization of the sub-coil units 9, 10. The strength of the dipole field $H_2$ along the z-axis is denoted by a in FIG. 3*a* and the strength of the sixpole field $H_6$ in planes at right angles to the z-axis is denoted by a' in FIG. 3*b*. The (front) sub-coil units 11 and 12 are formed by packets of turns which enclose windows 16 and 17, respectively. The window apertures are essentially of triangular shape, the point of the triangle facing the rear sub-coil units 9, 10, so as to generate upon energization of the sub-coil units a dipole field in combination with, from the rear to the front, a negative sixpole field and a positive sixpole field, respectively. In FIG. 3*a* the resulting dipole field is denoted by b and the resulting sixpole field is denoted by b' in FIG. 3*b*. It is obvious that by means of a deflection coil of the FIG. 2 type which is constructed from two sub-coils a frame deflection field can ge generated having a sixpole component which is strongly negative in the central area of the deflection field (so that astigmatism errors are minimum), is strongly positive on the gun side (so that coma errors are minimum), and on the screen side are sufficiently positive to make east-west frame distortion as small as possible.

Deflection fields having the characteristic of FIG. 3 can also be of importance for display devices having a monochrome picture tube of high resolution.

A particular aspect of the use of deflection coils of the FIG. 2 type is that by varying the distance S between the front sub-coil units 11, 12 and the rear sub-coil units 9, 10, the effect of the negative sixpole field in the central area can be made larger or smaller. Herewith it is possible to considerably correct astigmatism errors.

Referring back to FIG. 1 it should be pointed out that in the case of a self-converging system of a display tube 1 having a deflection unit 6 the line deflection field to be generated by the line deflection coil units 7, 8 should in known manner be pincushion-shaped on the side facing the display screen 4 and should be barrel-shaped on the side facing the electron gun system 3.

Furthermore it is still to be noted that the (rear) sub-coil units 9 and 10 are each constructed as saddle coils having two side packets, separated from each other in the circumferential direction and having on both their front side and on their rear side cross-over packets 18, 19 and 20, 21, respectively, lying in a plane parallel to the tube envelope 5. The (front) sub-coil units 11, 12 are each constructed as saddle coils having two side packets 22, 23 and 24, 25, respectively, separated from each other in the circumferential direction and having on their rear side cross-over packets 26 and 27 situated in a plane parallel to the tube envelope 5. This makes it possible for the annular core 13 which surrounds the assembly of coils to be constructed as one assembly.

The definitions used hereinbefore in the field of deflection will now be described with reference to FIGS. 4, 5 and 6.

Figure 4:
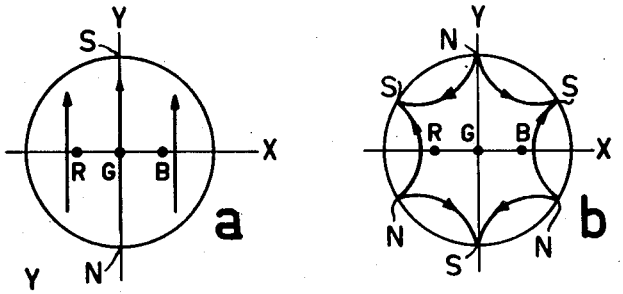
FIGS. 4*a* and *b* are cross-sectional views through a tube neck in which a dipole line deflection field (a) and a positive sixpole line deflection field (b) are shown diagrammatically.

FIG. 4 is a sectional view through a display tube along a plane at right angles to the z-axis, seen from the display screen side. Electron beams generated in the display tube are denoted by R, G and B. The arrows in FIG. 4*a* represent a dipole line deflection field. In the case of the orientation of the line deflection field shown, deflection of the electron beams will take place to the right. So the three electron beams are situated in the same plane as in which the deflection takes place. The arrows in FIG. 4*b* represent a sixpole field. The orientation of the sixpole field in FIG. 4*b* is such that the side beams R and B experience an extra deflection with respect to the central beam in the plane in which they are situated. In such a case the sixpole field is defined as a positive sixpole (line deflection) field. A sixpole field having an orientation which causes the outer beams to experience a smaller deflection than the central beam in the plane in which they are situated, is defined as a negative sixpole (line deflection) field. The sign of a sixpole frame deflection field is defined on the analogy of the comparable situation with a line deflection field.

Figure 5:
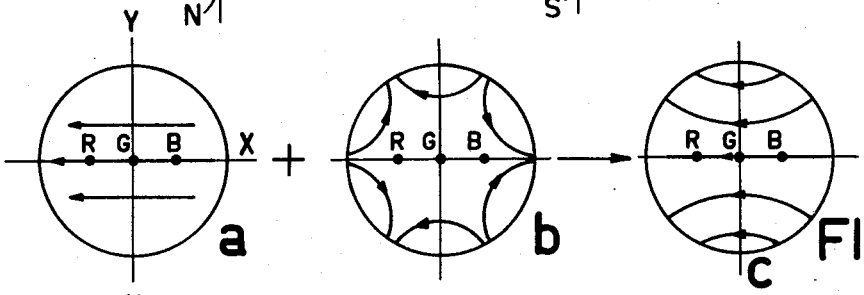
FIGS. 5*a–c* shows the effect of the combination of a positive dipole field with a positive sixpole field.

FIG. 5 is also a sectional view through a display tube along a plane at right angles to the z-axis seen from the display screen side. The arrows in FIG. 5*a* represent the dipole frame deflection field. In the case of the orientation of the dipole deflection field shown, deflection of the electron beams R, G and B will take place upwards. So in this case the three electron beams are in a plane at right angles to the plane in which the deflection takes place. The arrows in FIG. 5*b* represent a sixpole field. The orientation of the sixpole field in FIG. 5*b* is such that, on the analogy of the comparable situation with a line deflection field (for that purpose FIGS. 5*a* and 5*b* are to be rotated a quarter of a turn to the right), the sixpole field is termed positive. FIG. 5*c* shows the resulting frame deflection field which is pincushion-shaped.

Figure 6:
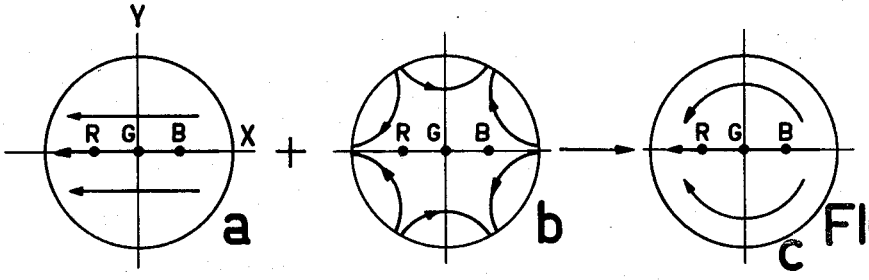
FIGS. 6*a–c* shows the effect of the combination of a positive dipole field with a negative sixpole field.

FIG. 6 is also a sectional view through a display tube taken along a plane at right angles to the z-axis, seen from the display screen side. The arrows in FIG. 6*a* represent the dipole frame deflection field. In the case of the orientation of the dipole deflection field as shown, deflection of the electron beams R, G and B will take place upwards. Therefore the three electron beams are situated in a plane at right angles to the plane in which deflection takes place. The arrows in FIG. 6*b* represent a sixpole field. The orientation of the sixpole field in FIG. 6*b* is such that, on the analogy of the comparable situation with a line deflection field, this sixpole field is termed negative. FIG. 6*c* shows the resulting frame deflection field which is barrel-shaped.

What is claimed is:

1. A device for displaying television pictures comprising a display tube in the neck of which an electron gun system is present for emitting at least one electron beam towards a display screen, and an electromagnetic deflection unit which is provided around the envelope of the display tube which comprises: a first deflection coil, and a second deflection coil situated coaxially with respect to the first deflection coil, each deflection coil comprising two diametrically oppositely located coil units, each coil unit of the first deflection coil consisting of two sub-coil units which are arranged axially with respect to each other on the side of the gun system and display screen, the sub-coil units which are present on the side of the gun system having a winding distribution for generating a dipole deflection field in combination with a positive sixpole deflection field, and the sub-coil units which are present on the side of the display screen having a winding distribution for generating a dipole field in combination with a negative sixpole field on their sides which are remote from the display screen, and a positive sixpole field on ther sides facing the display screen.

2. A device as claimed in claim 1, wherein the sub-coil units which are present on the side of the display screen are provided around a conical portion of the display tube, and the sub-coil units which are present on the side of the gun system are provided around a neck portion of the display tube.

3. A device as claimed in claim 1 or 2, wherein the sub-coil units facing the gun system are of the saddle type.

4. A device as claimed in claim 3, wherein the sub-coil units facing the gun system have packets of turns which enclose windows having a substantially rectangular shape.

5. A device as claimed in claim 1 or 2, wherein both the sub-coil units facing the gun system and the sub-coil units facing the display screen are of the saddle type.

6. A device as claimed in claim 5, wherein the sub-coil units facing the display screen have packets of turns which enclose windows having an essentially triangular shape, in which the narrowest portion of the windows is remote from the display screen and that the sub-coil units facing the gun system have packets of turns which enclose windows having a substantially rectangular shape.

7. A device as claimed in claim 6, wherein an annular core of soft-magnetic material consisting of one assembly coaxially surrounds both the sub-coil units facing the display screen and the sub-coil units facing the gun system.

8. A device according to claim 1 wherein the distance between the sub-coil units facing the gun system and the sub-coil units facing the display screen is adjusted to provide a minimum astigmatism error.

* * * * *